US006638178B2

(12) United States Patent
Tseng

(10) Patent No.: US 6,638,178 B2
(45) Date of Patent: Oct. 28, 2003

(54) GOLF CLUB

(76) Inventor: Wen-Cheng Tseng, No. 27, Kung Chuan Rd., Tai-Shan Hsiang, Taipei Hsien (TW)

( * ) Notice: Subject to any disclaimer, the term of this patent is extended or adjusted under 35 U.S.C. 154(b) by 0 days.

(21) Appl. No.: 10/010,204

(22) Filed: Dec. 6, 2001

(65) Prior Publication Data

US 2002/0169032 A1 Nov. 14, 2002

(30) Foreign Application Priority Data

May 11, 2001 (TW) ..... 90207743 U

(51) Int. Cl.[7] ..... A63B 53/102
(52) U.S. Cl. ..... 473/306; 473/312
(58) Field of Search ..... 473/288, 298, 473/299, 307, 312, 306, 295

(56) References Cited

U.S. PATENT DOCUMENTS 4,340,227 A * 7/1982 Dopkowski ..... 473/288
4,693,475 A * 9/1987 Keilhau ..... 473/552
5,181,720 A * 1/1993 Stites et al. ..... 473/312
5,653,645 A * 8/1997 Baumann ..... 473/305

* cited by examiner

*Primary Examiner*—Stephen Blau
(74) *Attorney, Agent, or Firm*—Alan D. Kamrath; Rider Bennett LLP

(57) ABSTRACT

A golf club has a head with a fixing hole defined therein to receive a connecting portion of a shaft fixed therein, and an adjusting means particularly provided therein to enable the head to be adjustable until a desired dynamic balance and stability of the golf club are reached. The adjusting means includes a connecting spindle having a first end thereof fixed in the connecting portion and a second end thereof formed with a connector inserted into the fixing hole of the head, and a fastening member threaded through a screw hole defined at one side of the fixing seat and extending into the fixing hole. A tip end of the fastening member formed with a cone surface is correspondingly abutted against an inclined surface formed around an annular groove defined around the connector.

14 Claims, 6 Drawing Sheets

GOLF CLUB

BACKGROUND OF THE INVENTION

1. Field of the Invention

The present invention relates to a golf club having an adjusting means provided therein to enable a head thereof to be adjustable until the golf club reaches a desired dynamic balance and stability.

2. Description of Related Art

Conventionally, a golf club generally comprises a shaft, a head and a grip. When playing, the grip of the golf club must be he d properly, and the correct posture assumed to prepare for striking the ball. Then, the club is s to the ball, and the ball travels from the tee to a target place.

However, due to the irregular configuration, the high density and weight of the head and the long length of the shaft, when e head of the golf club is moving at a very high speed from a high position above the player's he towards a low position at the player's feet, a twisting force is exerted on the head of the golf club. This force may cause the head portion of the golf club to be twisted, so that the actual striking point is deviated from the preliminary striking point, and so the ball may be miss-hit. Therefore, the dynamic balance and stability of the golf club are very important qualities to prevent the head portion of the golf club from any undesirable deviation so as to affect success in striking the ball.

Presently, a testing fixture is usually used to test the dynamic balance and stability of finished golf clubs. In a test after the grip end of the golf club is clamped on the testing fixture and extending horizontally, the head end of the golf club is pressed downwardly for a distance and then freed. If the head of the golf club bounces up and down in a substantially straight way, the dynamic balance and stability of the golf club is acceptable; otherwise, if the head of the golf club bounces up and down in a twisting way, the dynamic balance and stability of the golf club is not acceptable.

However, the testing fixture for dynamic balance and stability is only used to test finished golf clubs, whereby a final quality procedure is used to determine the unacceptable golf clubs. Because the fixing angle of the head of the finished golf club is now irreversibly set, no further adjustment of the fixing angle of the head can be performed. Therefore, the value of the scrapped product is high.

Therefore, it is an objective of the invention to provide a golf club with an adjusting device provided therein to mitigate and/or obviate the aforementioned problems.

SUMMARY OF THE INVENTION

The main object of the present invention is to provide a golf club having a head defined with a fixing hole to receive a connecting portion of a shaft fixed therein, and an adjusting means particularly provided therein to enable the head to be adjustable until a desired dynamic balance and stability of the golf club are reached. The adjusting means includes a connecting spindle having a first end thereof fixed in the connecting portion and a second end thereof formed with a connector inserted into the fixing hole of the head, and a fastening member threaded through a screw hole defined at one side of the fixing seat and extending into the fixing hole. The connector is defined with an annular groove, which is formed with an inclined surface therearound. A tip end of a thread portion of the fastening member is formed with a cone surface corresponding to the inclined surface of the annular groove. When the fastening member is screwed inwardly, the cone surface of the tip end of the fastening member is abutted against the incline surface to fix the head with the connecting portion of the shaft. When the fastening member is screwed outwardly, the connecting spindle is released and the head is then adjustable.

Other objects, advantages and novel features of the invention will become more apparent from the following detailed description when taken in conjunction with the accompanying drawings.

DETAILED DESCRIPTION OF THE PREFERRED EMBODIMENT

Figure 1:
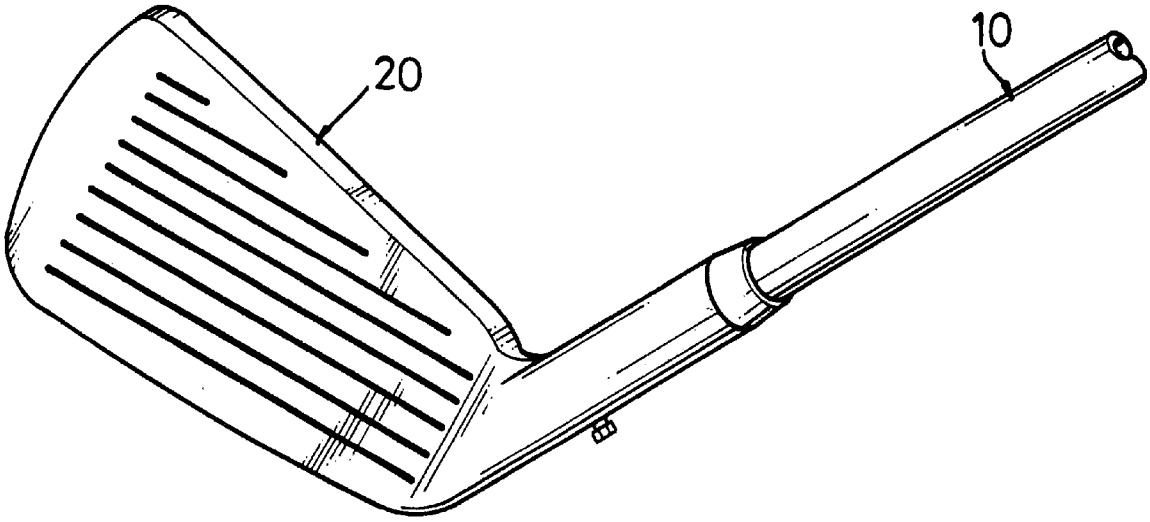
FIG. 1 is a partial perspective view of a golf club in accordance with the invention.
Figure 2:
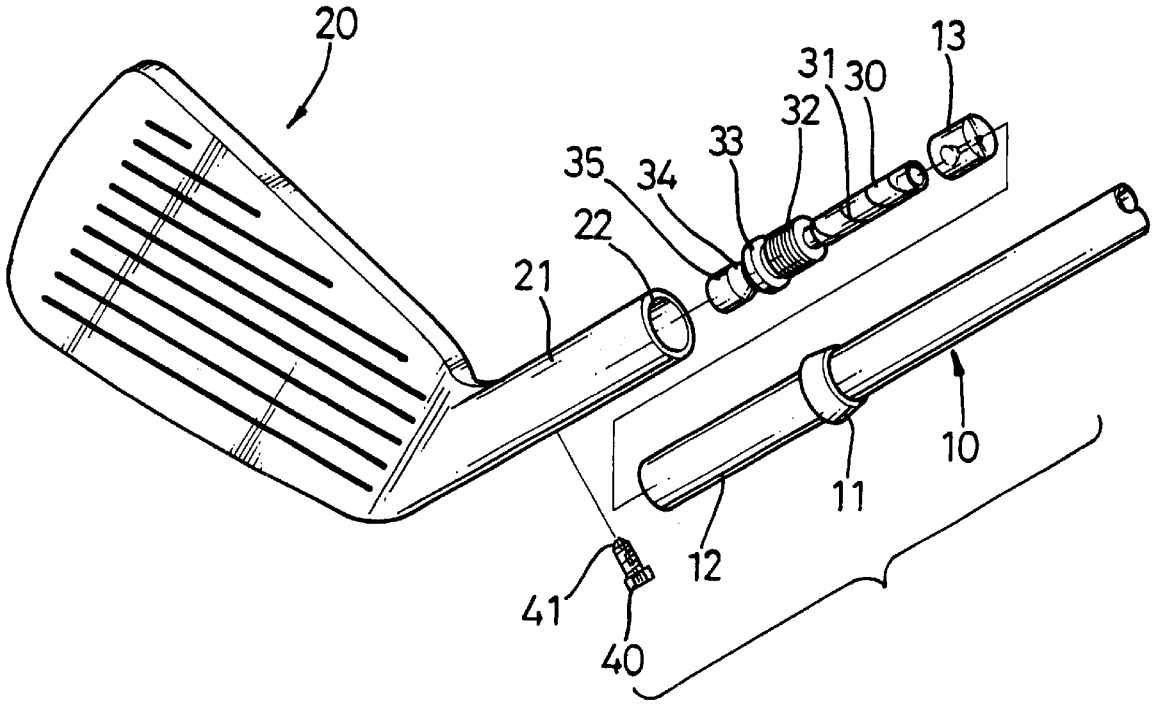
FIG. 2 is an exploded perspective view of the golf club in accordance with the invention.

As shown in FIGS. 1 and 2, a golf club in accordance with the invention includes a shaft (10) having a connecting portion (12) formed at a lower end thereof and a sleeve (11) mounted therearound, and a head (20) having a fixing seat (21) formed at one side thereof with a fixing hole (22) defined in a center of the fixing seat (21) to receive the connecting portion (12) fixed therein. Wherein an adjusting means is particularly provided in the golf club.

The adjusting device includes a connecting spindle (30) fixed in the golf club and a fastening member (40) threaded through the fixing seat (21) and extending into the fixing hole (22).

The adjusting device consists of a connecting spindle (30) fixed in the golf club and a fastening member (40) threaded through the fixing seat (21) and extending into the fixing hole (22).

The connecting spindle (30) sequentially has a spiral flute (31) defined around a first end portion thereof, a joint portion (32) formed in a middle thereof, a retaining ring (33) formed next to the joint portion (32), and a connector (35) formed at a second end thereof. Two necking-downs are respectively defined between the first end portion to the joint portion (32) and the joint portion (32) to the retaining ring (33). The joint portion (32) has a male thread defined therearound corresponding to a female thread defined in a lower end portion of the connecting portion (12). The retaining ring (33) has a diameter substantially equal to an external diameter of the connecting portion (12). An annular groove (34) is defined around the connector (35) and formed with an inclined surface therearound.

Figure 3:
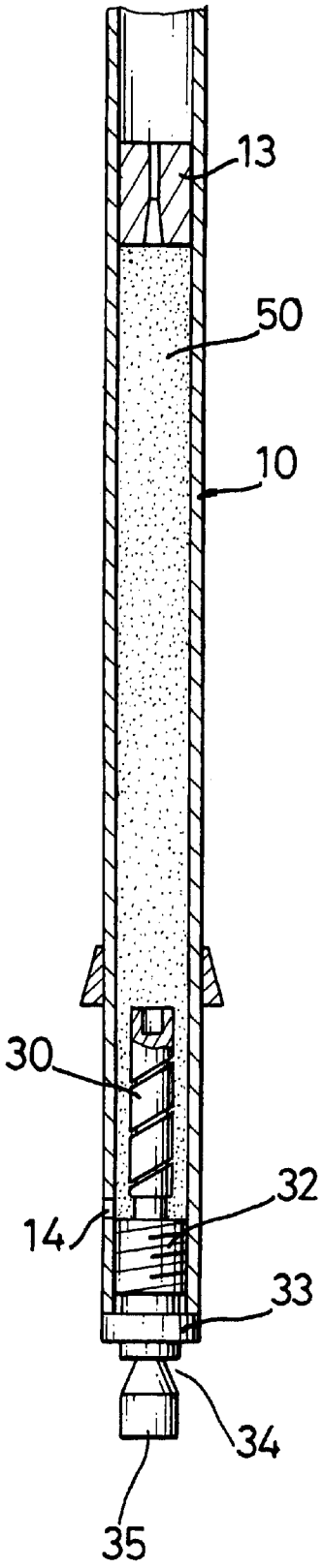
FIG. 3 is a partial cross sectional view of the golf club in accordance with the invention.

As illustrated in FIGS. 3 an 4, a stopper (13) with an orifice (131) defined therein is first fitted in the shaft (10). Then, a filling material (50) is charged into an internal space of the shaft (10). The first end portion of connecting spindle (30) is inserted into the connecting portion (12) of the shaft (10), the male thread of the joint portion (32) is threadingly engaged with the female thread of the connecting portion (12), and the retaining ring (33) is retained by an end face of the connecting portion (12). The filling material (50) is preferably made of one type of elastic material. When the connecting spindle (30) is threadingly engaged into the connecting portion (12) of the shaft (10), the filling material (50) overflows from the orifice of the stopper (13) and a spout hole (14) defined at one side wall of the connection portion (12).

Figure 4:
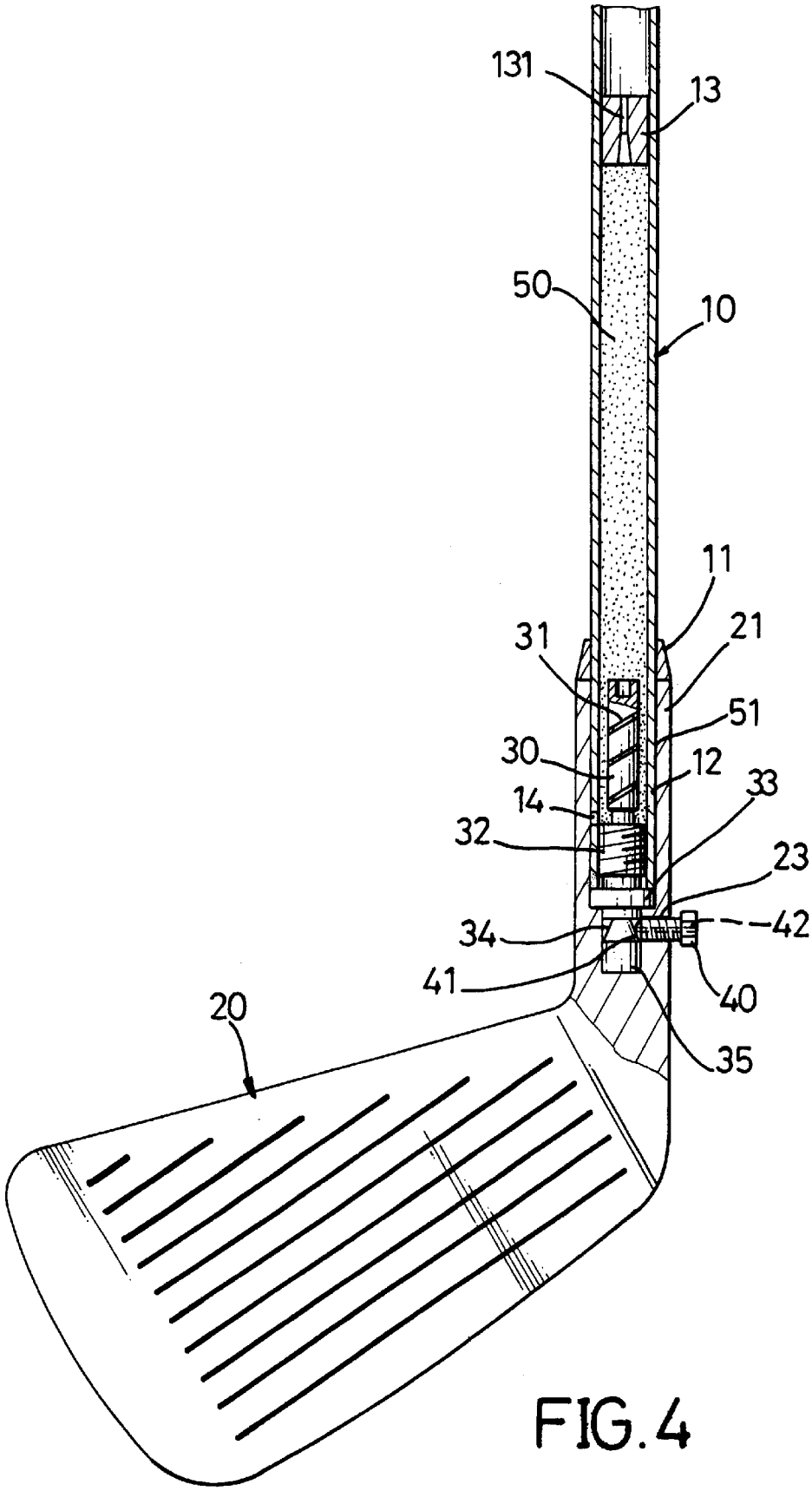
FIG. 4 is a cross sectional assembly view of the golf club in accordance with the invention.

With reference to FIG. 4, first an adhesive material (51) which will become solidified after a period of time is applied on internal surface of the fixing hole (22) of the fixing seat (21). The connecting portion (12) is then inserted into the fixing hole (22), and the connector (35) of the connecting spindle (30) is inserted into the fixing hole (22). The fastening member (40) has a thread portion threaded through a screw hole (23) defined at one side of the fixing seat (21) and extending into the fixing hole (22). A tip end of the thread portion of the fastening member (40) is formed with a cone surface (41) corresponding to the inclined surface of the annular groove (34) of the connector (35). When the fastening member (40) is screwed inwardly, as the inclined surface of the connector (35) is abutted against the cone surface (41) of the fastening member (40), the connecting spindle (30) is driven by the fastening member (40) to turn in a direction that the joint portion (32) of the connecting spindle (30) is screwed outward from the connecting portion (12), and the connector (35) moves towards a bottom of the socket of the fixing hole (22).

Figure 5:
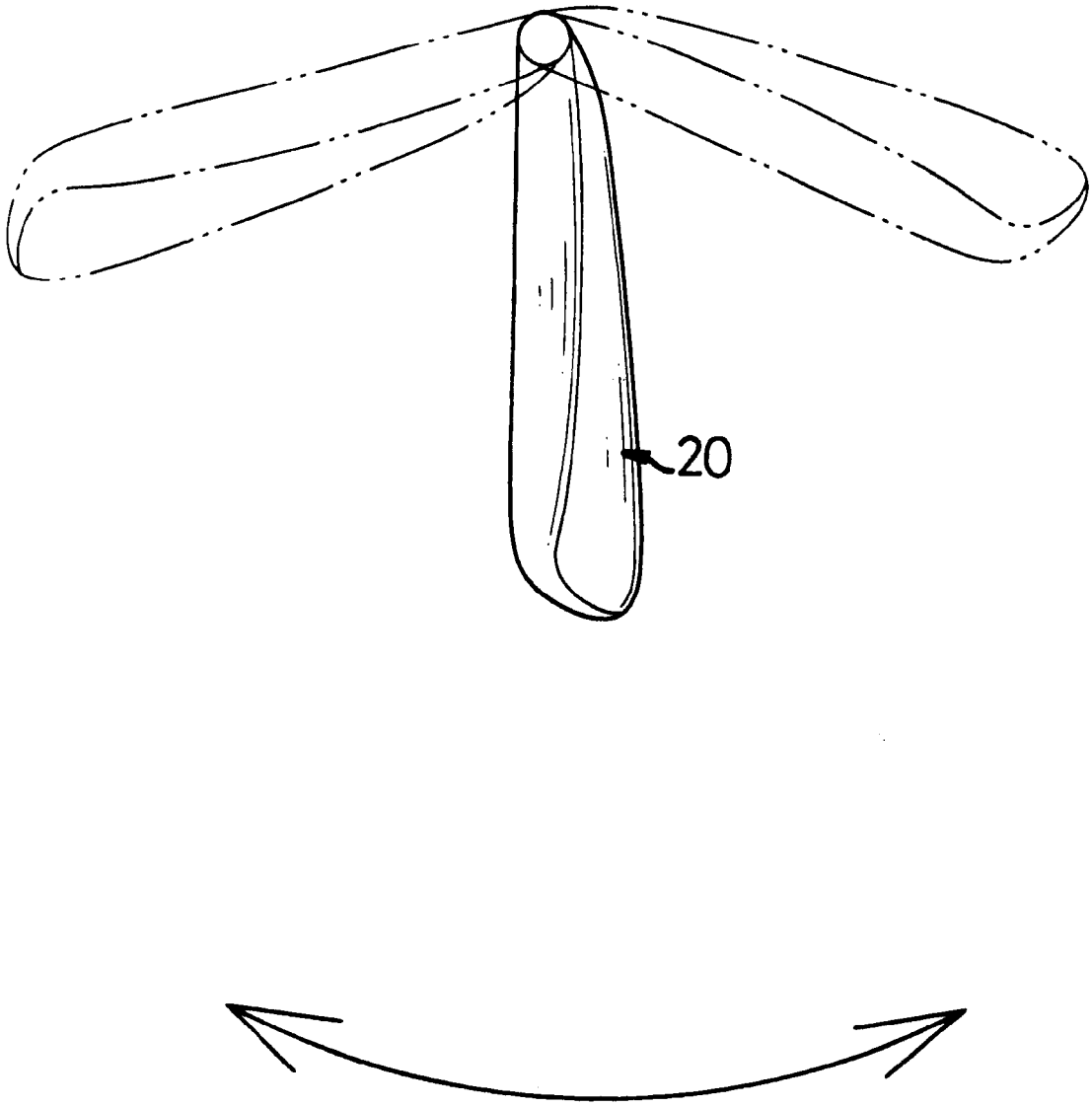
FIG. 5 is a schematic view showing a head of a golf club being adjusted.
Figure 6:
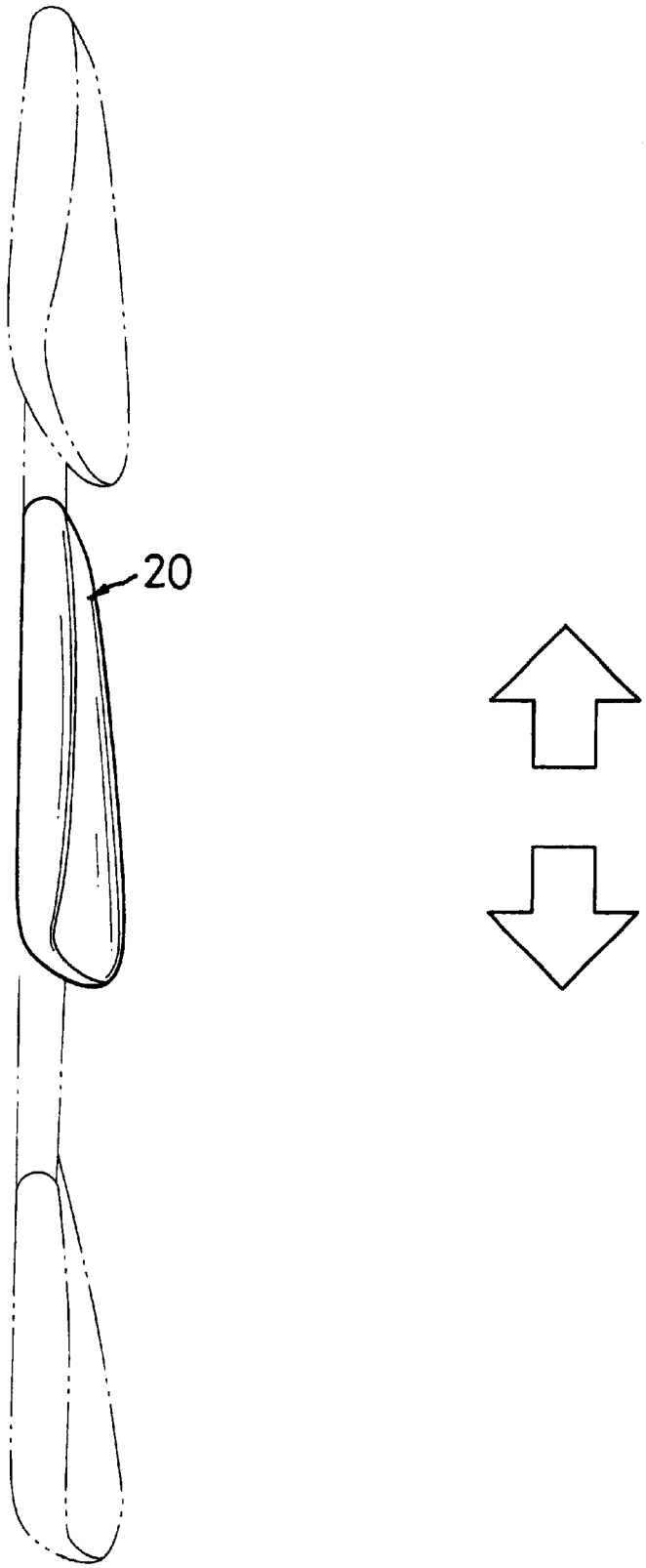
FIG. 6 is a schematic view showing a golf club being tested in a dynamic testing.

Before the adhesive material (51) becomes solidified, if the fastening member (40) is screwed outwardly, the fixing angle of the head (20) is adjustable as shown in FIG. 5. After the head (20) is fixed with the shaft (10) by screwing the fastening member (40) inwardly, the golf club can be clamped on a testing fixture for a dynamic balance and stability test. If the head (20) of the golf club moves up and down along a substantially straight way as shown in FIG. 6, the dynamic balance and stability of the golf club is acceptable, that means the head (20) is positioned at a desired fixing angle. Finally, after the adhesive material (51) is solidified, the connecting portion (12) is fixedly secured in the fixing hole (22) of the head (20) at the desired fixing angle. Afterwards, a protruded portion (42) of the fastening member (40) is cut, and a cut face of the fastening member (40) is machined to get a nice surface quality.

The golf club in accordance with the invention has an advantage that the head (20) is adjustable before the adhesive material (51) is solidified. Therefore, the golf club is adjustable to reach a desired dynamic balance and stability, which results in that the defective product ratio of the golf club is very low.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A golf club comprising:

a shaft formed with a connecting portion at a lower end thereof, the connecting portion having a female thread defined in a low end portion of the connecting portion, a head having a fixing seat formed at one side thereof and a fixing hole defined in a center of the fixing seat to receive the connecting portion fitted therein, an adjusting means including a connecting spindle having a first end thereof inserted into the connecting portion, a joint portion integrally formed at a middle of the connecting spindle and having a male thread defined around the joint portion and corresponding to the female thread of the connecting portion, with the connecting spindle having a second end thereof formed with a connector inserted into the fixing hole of the head, and a fastening member threaded with a screw hole defined at one side of the fixing seat and extending into the fixing hole and having a tip end thereof formed with a cone surface corresponding to an annular groove defined around the connector, whereby when the fastening member is screwed inwardly, the cone surface of the fastening member is abutted against the annular groove of the connector, and the connecting portion of the shaft is securely fixed in the fixing hole of the fixing seat, when the fastening member is screwed outwardly, the connecting spindle is released, so that the head is adjustable, wherein a stopper defined with an orifice is fitted in the shaft, and a spout hole is defined at one side of the connecting portion.

2. The golf club as claimed in claim 1, wherein a retaining ring is integrally formed around the connecting spindle between the joint portion and the connector, the diameter of the retaining ring is equal to an external diameter of the connecting portion.

3. The golf club as claimed in claim 2, wherein an adhesive material is applied between the connecting portion of the shaft and the fixing hole of the fixing seat.

4. The golf club as claimed in claim 1, wherein a filling material is charged in an internal space of the shaft between the stopper and the connecting spindle.

5. The golf club as claimed in claim 4, wherein the filling material is made of one type of elastic material.

6. The golf club as claimed in claim 5, wherein an adhesive material is applied between the connecting portion of the shaft and the fixing hole of the fixing seat.

7. The golf club as claimed in claim 1, wherein an adhesive material is applied between the connecting portion of the shaft and the fixing hole of the fixing seat.

8. The golf club as claimed in claim 1, wherein the annular groove is formed with an inclined surface defined around the connector, with the cone surface of the fastening member abutted against the inclined surface of the annular groove of the connector.

9. A golf club comprising:

a shaft formed with a connecting portion at a lower end thereof, the connecting portion having a female thread defined in a low end portion of the connecting portion, a head having a fixing seat formed at one side thereof and a fixing hole defined in a center of the fixing seat to receive the connecting portion fitted therein, an adjusting means including a connecting spindle having a first end thereof inserted into the connecting portion, a joint portion integrally formed at a middle of the connecting spindle and having a male thread defined around the joint portion and corresponding to the female thread of the connecting portion, with the connecting spindle having a second end thereof formed with a connector inserted into the fixing hole of the head, and a fastening member threaded with a screw hole defined at one side of the fixing seat and extending into the fixing hole and having a tip end thereof formed with a cone surface corresponding to an annular groove defined around the connector, whereby when the fastening member is screwed inwardly, the cone surface of the fastening member is abutted against the annular groove of the connector, and the connecting portion of the shaft is securely fixed in the fixing hole of the fixing seat, when the fastening member is screwed outwardly, the connecting spindle is released, so that the head is adjustable, wherein the annular groove is formed with an inclined surface defined around the connector, with the cone surface of the fastening member abutted against the inclined surface of the annular groove of the connector, wherein the connecting spindle has a spiral flute defined around a first end portion thereof.

10. The golf club as claimed in claim 9, wherein a retaining ring is integrally formed around the connecting spindle between the joint portion and the connector, the diameter of the retaining ring is equal to an external diameter of the connecting portion.

11. The golf club as claimed in claim 10, wherein a stopper defined with an orifice is fitted in the shaft, and a spout hole is defined at one side of the connecting portion.

12. The golf club as claimed in claim 11, wherein a filling material is charged in an internal space of the shaft between the stopper and the connecting spindle.

13. The golf club as claimed in claim 12, wherein the filling material is made of one type of elastic material.

14. The golf club as claimed in claim 13, wherein an adhesive material is applied between the connecting portion of the shaft and the fixing hole of the fixing seat.

* * * * *